US006273479B1

(12) United States Patent
Carlson

(10) Patent No.: US 6,273,479 B1
(45) Date of Patent: Aug. 14, 2001

(54) UNIT FOR TYING A BALLOON AND SECURING A RIBBON TO THE BALLOON

(76) Inventor: Leland R. Carlson, 503 County Line Rd., Fayetteville, GA (US) 30215-4622

( * ) Notice: Subject to any disclaimer, the term of this patent is extended or adjusted under 35 U.S.C. 154(b) by 0 days.

(21) Appl. No.: 09/696,976

(22) Filed: Oct. 27, 2000

(51) Int. Cl.[7] ..... D03J 3/00

(52) U.S. Cl. ..... 289/17; 289/1.2; 289/1.5; 289/18.1

(58) Field of Search ..... 289/1.2, 1.5, 2, 289/17, 18.1; 446/220, 222

(56) References Cited

U.S. PATENT DOCUMENTS

| | | | | |
|---|---|---|---|---|
| D. 245,755 | | 9/1977 | Lewis . | |
| 4,510,653 | | 4/1985 | Semanko . | |
| 4,802,877 | | 2/1989 | Davis . | |
| 4,936,532 | | 6/1990 | Williams . | |
| 4,989,906 | | 2/1991 | Peverley . | |
| 5,039,142 | * | 8/1991 | Muma | 289/17 |
| 5,044,584 | | 9/1991 | Lin . | |
| 5,104,160 | * | 4/1992 | Cheng | 289/17 |
| 5,314,217 | | 5/1994 | Place . | |
| 5,568,950 | | 10/1996 | Herren . | |
| 5,611,578 | | 3/1997 | Angelico . | |
| 5,628,091 | | 5/1997 | Mueller . | |
| 5,647,615 | | 7/1997 | Messier . | |
| 5,820,169 | | 10/1998 | Butler . | |
| 5,882,051 | * | 3/1999 | Dreger et al. | 289/17 |
| 6,082,785 | | 7/2000 | Morgan . | |

* cited by examiner

*Primary Examiner*—John J. Calvert
*Assistant Examiner*—Gary L. Welch
(74) *Attorney, Agent, or Firm*—Terry M Gernstein

(57) ABSTRACT

A unit is mounted directly on a tank of pressurized gas used to inflate a balloon and includes a supporting bracket having ribbon-accommodating holes defined through one end thereof and a support section on the other end. A ribbon supporting spool is rotatably mounted on the support section and ribbon drawn off the spool is threaded through the ribbon-accommodating holes to be captured in a knot formed in the neck of the balloon after that neck has been drawn around the supporting bracket and formed into a knot. A method of forming a knot in the balloon and capturing the ribbon therein is also disclosed.

14 Claims, 9 Drawing Sheets

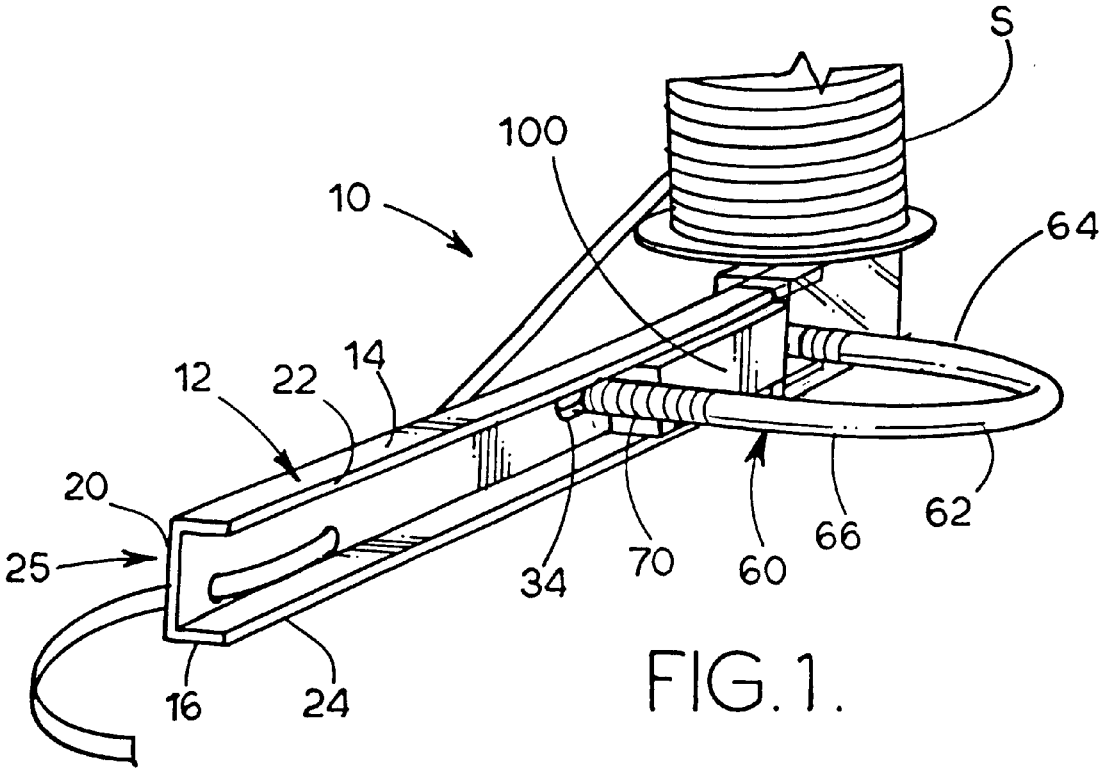
FIG. 1.
FIG. 2.
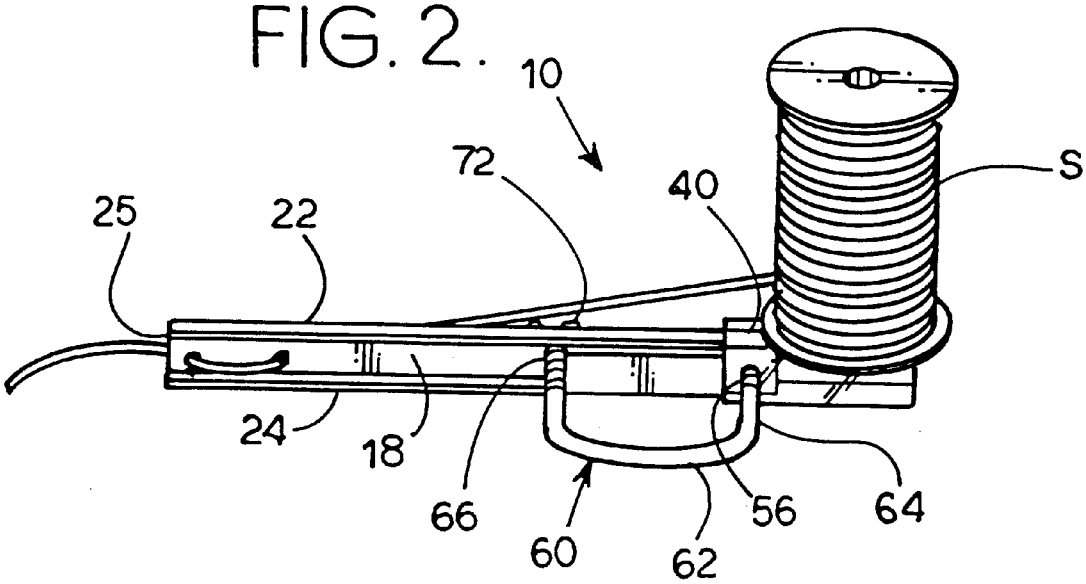

FIG. 3.
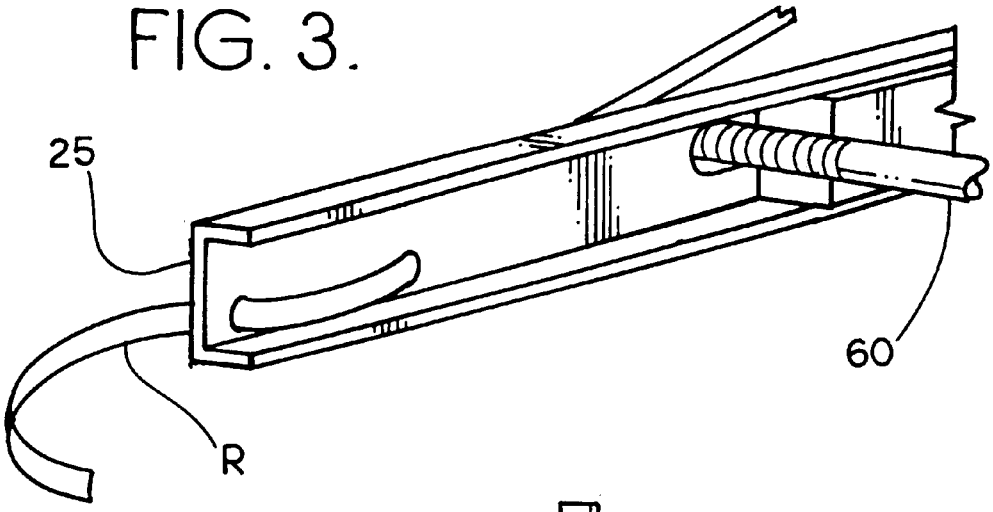
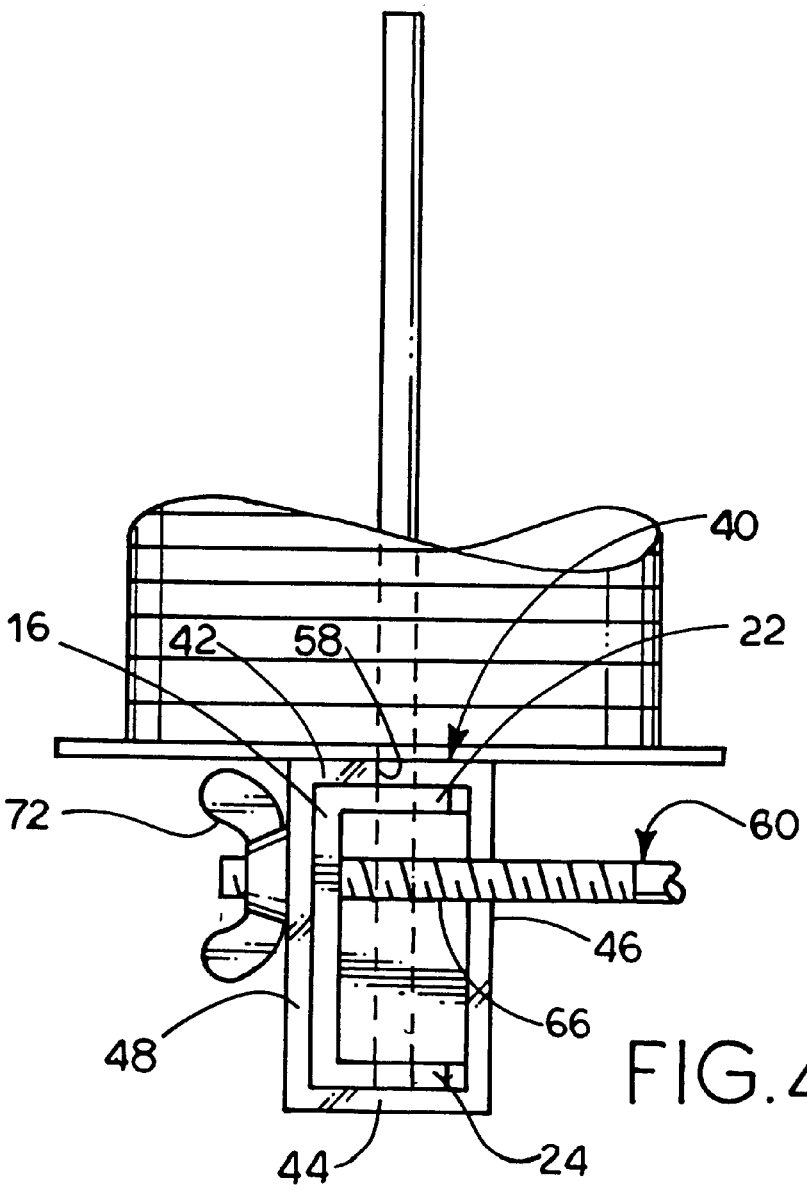
FIG. 4.

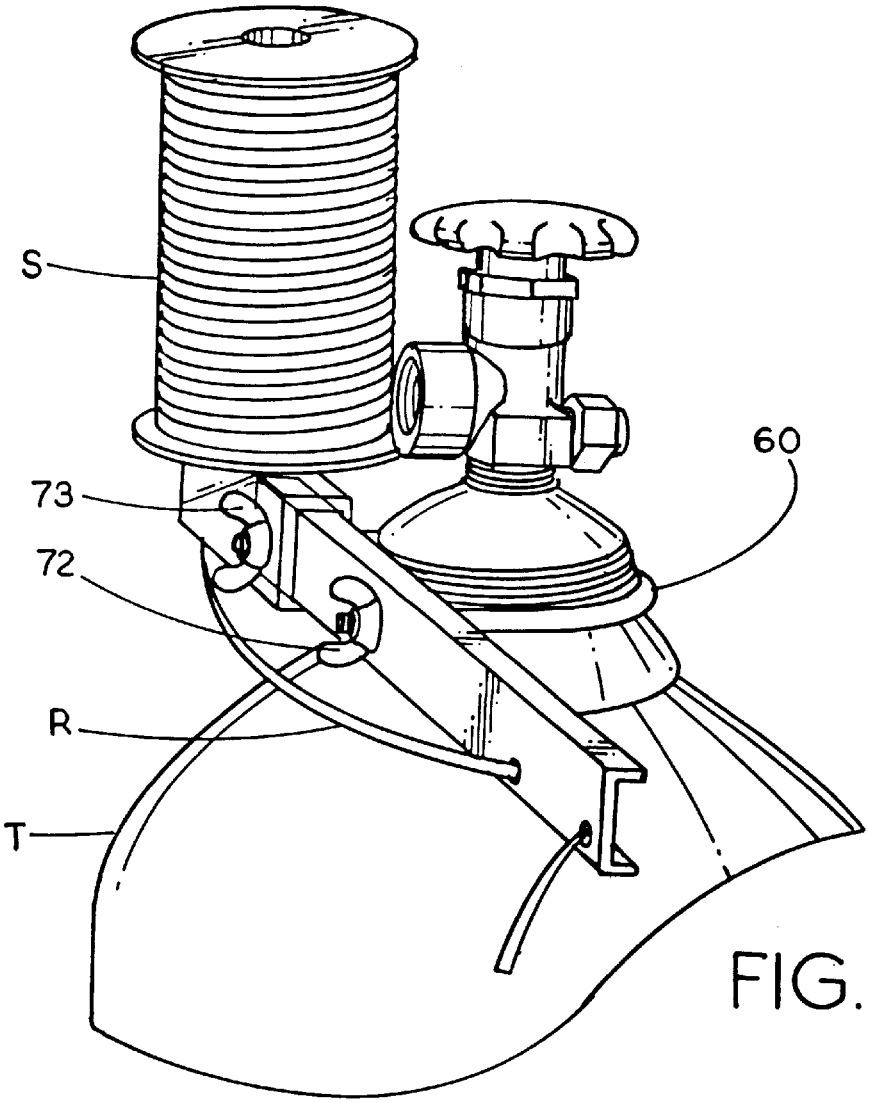
FIG. 10.
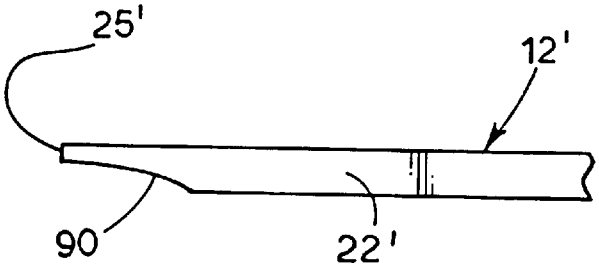
FIG. 11A.
FIG. 11B.
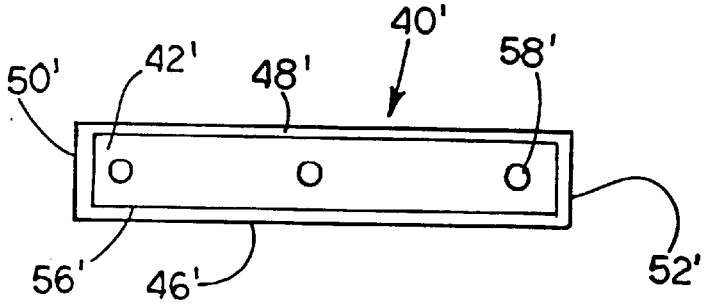

UNIT FOR TYING A BALLOON AND SECURING A RIBBON TO THE BALLOON

TECHNICAL FIELD OF THE INVENTION

The present invention relates to the general art of amusement devices, and to the particular field of inflatable toys having an externally applied sealing element as well as to the field of knot tying and means peculiarly adapted to assist the hand or operated by hand to form a knot by forming a loop through which a portion of a the inflatable toy is passed and the loop tightened.

BACKGROUND OF THE INVENTION

Many situations include providing balloons for people. Examples of such situations include parties, fairs, promotional activities and the like. Often, a multiplicity of balloons must be inflated and sealed. This is often a difficult task, especially if speed is required as is often the case in a situation where a great number of inflated balloons are to be provided.

The situation involving inflating and sealing a multiplicity of balloons generally requires use of a tank of pressurized gas. Each balloon is placed over an exhaust nozzle of the tank, a valve opened, the balloon inflated to a desired size and the valve closed. Once inflated, the balloon must be sealed. This generally is carried out by tying a neck portion of the balloon.

Tying an inflated balloon requires some manual dexterity, and there is a limit to how fast such an operation can be carried out. This is especially true of the balloon neck is not supported in some manner during the tying process as the operator must supply the support during the neck tying process.

Accordingly, the art contains several systems for inflating and sealing off balloons. However, these known systems are often cumbersome, expensive and difficult to use. Still further, many such known systems are not entirely and efficiently amenable to use on a tank of pressurized gas. Furthermore, many of these known systems are fragile.

Often, balloons are sealed off and a ribbon is then attached to the balloon. The ribbon can be decoration in and of itself or it can serve to attach the balloon to another element, such as a greeting card or the like.

Attaching a ribbon to an inflated balloon adds yet another difficultly to the above-discussed problems.

While the art does contain systems for sealing an inflated balloon and attaching a ribbon to such sealed balloon, these known systems are often cumbersome, fragile, difficult to use and are not amenable to use in a variety of situations. This makes such known systems inefficient.

Still further, many of these known systems; are not amenable to packaging with ribbon to be sold as a kit. Therefore, their use is somewhat limited.

Still further, if a prior art system supports a spool of ribbon, that ribbon is often supported in a position that is not as stable as it could be. Ribbon is often being pulled off a spool in a manner that may pull the spool off the support. If a spool of ribbon is pulled off its support, the overall process is slowed down, or the ribbon may be damaged or soiled, all of which are wasteful.

Still further, many known systems are designed for use by a right-handed person and are very difficult, if not impossible, for a left-handed person to use. In order to be most efficient, such a system should be amenable to efficient use by either a right-handed person or a left-handed person.

Furthermore, pressurized gas can be sold in a wide variety of containers having various sizes and shapes. Many known systems can only be efficiently used with large cylindrical tanks. This limits the number of situations in which these known systems can be efficiently used.

Therefore, there is a need for a unit which can be efficiently used to externally seal an inflated balloon that is easy to use by either hand, is amendable to a wide variety of applications and can be packaged with ribbon.

OBJECTS OF THE INVENTION

It is a main object of the present invention to provide a unit for tying a balloon which is compact, easily stored and used.

It is another object of the present invention to provide a unit for sealing a balloon which can be easily used by either a right-handed or a left-handed person.

It is another object of the present invention to provide a unit for sealing a balloon which can be packaged with ribbon.

It is another object of the present invention to provide a unit for sealing a balloon which can be used with a wide variety of tanks of pressurized gas used to inflate balloons.

It is another object of the present invention to provide a unit for sealing a balloon which securely supports spools of ribbon thereon.

It is another object of the present invention to provide a unit for sealing a balloon which can be easily stored in kit form.

SUMMARY OF THE INVENTION

These, and other, objects are achieved by a unit which includes a minimum number of simple and compact elements which are easily and quickly assembled with each other and mounted on a tank in a universal manner. Once mounted on a tank, the unit securely supports itself on the tank and also securely supports the ribbon spool. The unit is also amenable to use with a plurality of spools of ribbon. Furthermore, the unit is amenable to being stored and sold in a kit form either alone or in combination with a ribbon spool and is easily used by either a right-handed user or a left-handed user.

More specifically, the unit includes a supporting bracket having a support section attached thereto by a mounting element when the mounting element mounts the supporting bracket on a tank. A ribbon supporting unit is supported on the support section and ribbon from the spool supported on the ribbon supporting unit is threaded through holes in the supporting bracket so that a balloon neck wound around the supporting bracket encircles the ribbon. Removing the balloon neck from the supporting bracket captures the ribbon. Tying the ribbon thus ties off and seals the balloon.

The unit is mounted on a tank of gas used to inflate balloons adjacent to the exhaust valve of the tank. A balloon is easily inflated using the exhaust valve of the tank and is then easily and quickly moved to a position to be wrapped around the supporting bracket and the ribbon.

BRIEF DESCRIPTION OF THE DRAWING FIGURES

FIG. 1 is a perspective view of a unit used to seal a balloon and tie a ribbon to a balloon embodying the present invention.

FIG. 2 is a side elevational view of the unit.

FIG. 3 is a side perspective view of the unit with ribbon in position to be placed on a balloon during the sealing of the balloon.

FIG. 4 is an end view of the unit.

FIG. 10 shows another view of the unit in place.

FIG. 11A shows an alternative supporting bracket.

FIG. 11B shows an alternative form of a support section of the unit which is adapted to support a plurality of ribbon spools.

DETAILED DESCRIPTION OF THE PREFERRED EMBODIMENT OF THE INVENTION

Other objects, features and advantages of the invention will become apparent from a consideration of the following detailed description and the accompanying drawings.

Figure 12:
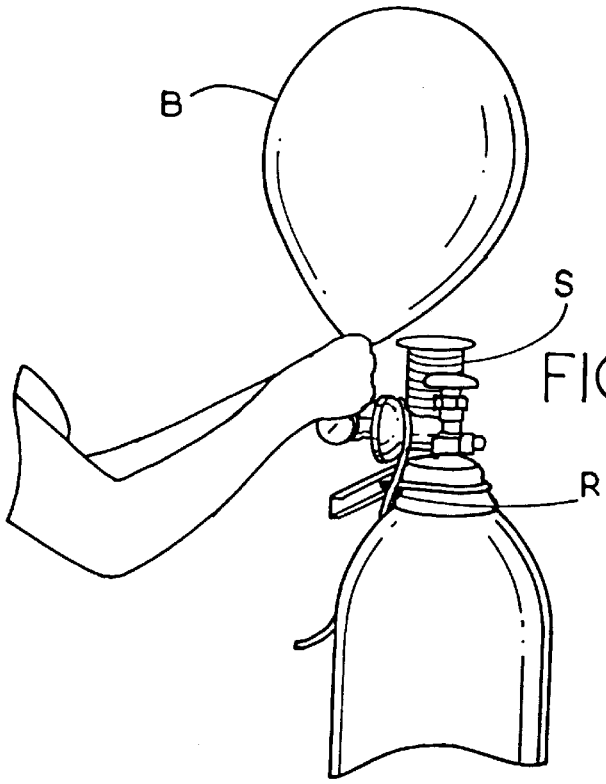
FIGS. 12–15 illustrate steps in a method of using the unit of the present invention.
Figure 13:
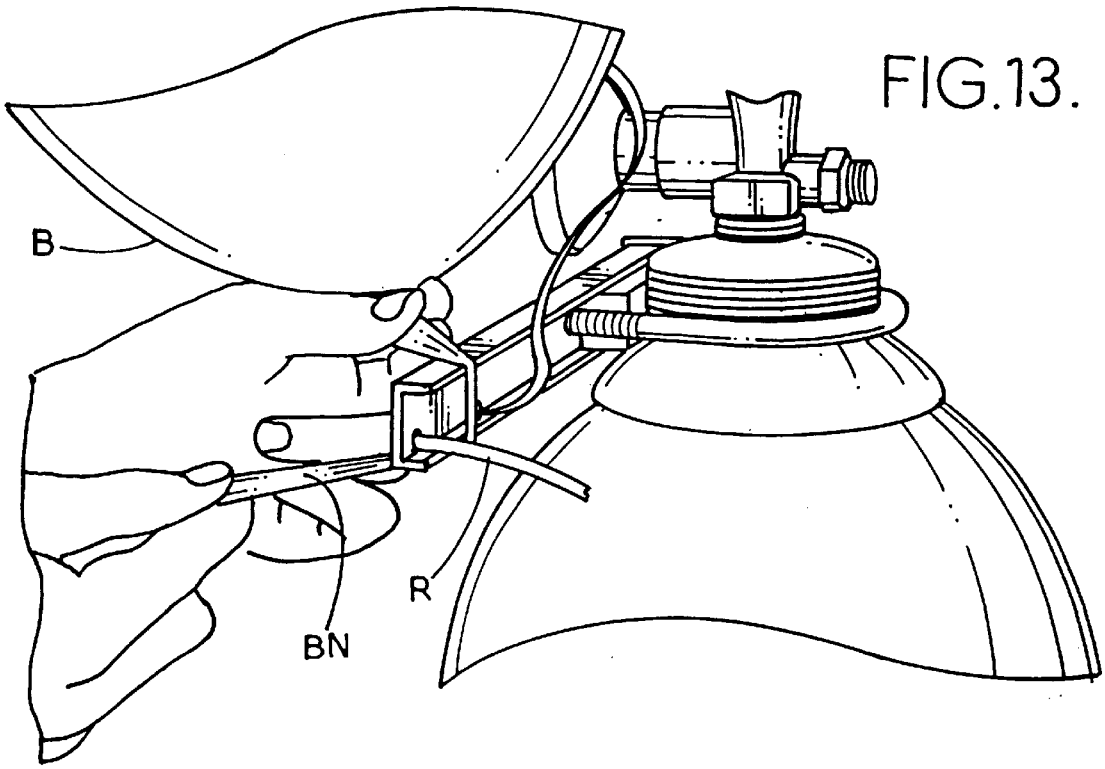
Figure 15:
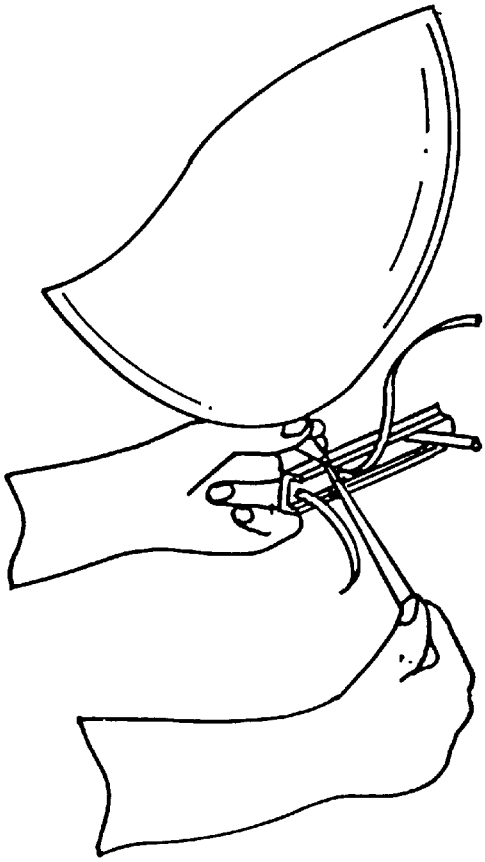

Referring first to FIGS. 1–7, a unit 10 is used to tie a ribbon R from a spool S to a balloon B (see FIGS. 12, 13 and 15). Unit 10 includes a supporting bracket 12 that has a one-piece section 14 that is formed of metal or plastic as suitable. It is noted that plastic may be less expensive to manufacture than metal and may make it easier to manipulate a balloon neck as will be understood from the following disclosure.

Section 14 includes a central section 16 having an inside surface 18 and an outside surface 20 and two side portions 22 and 24 that extend parallel to each other and which, together with central section 16, form a U shape. Section 14 is elongate and has a distal end 25 and a proximal end 26 (best shown in FIG. 7) and a longitudinal dimension CL extending from distal end 25 to proximal end 26.

Figure 5:
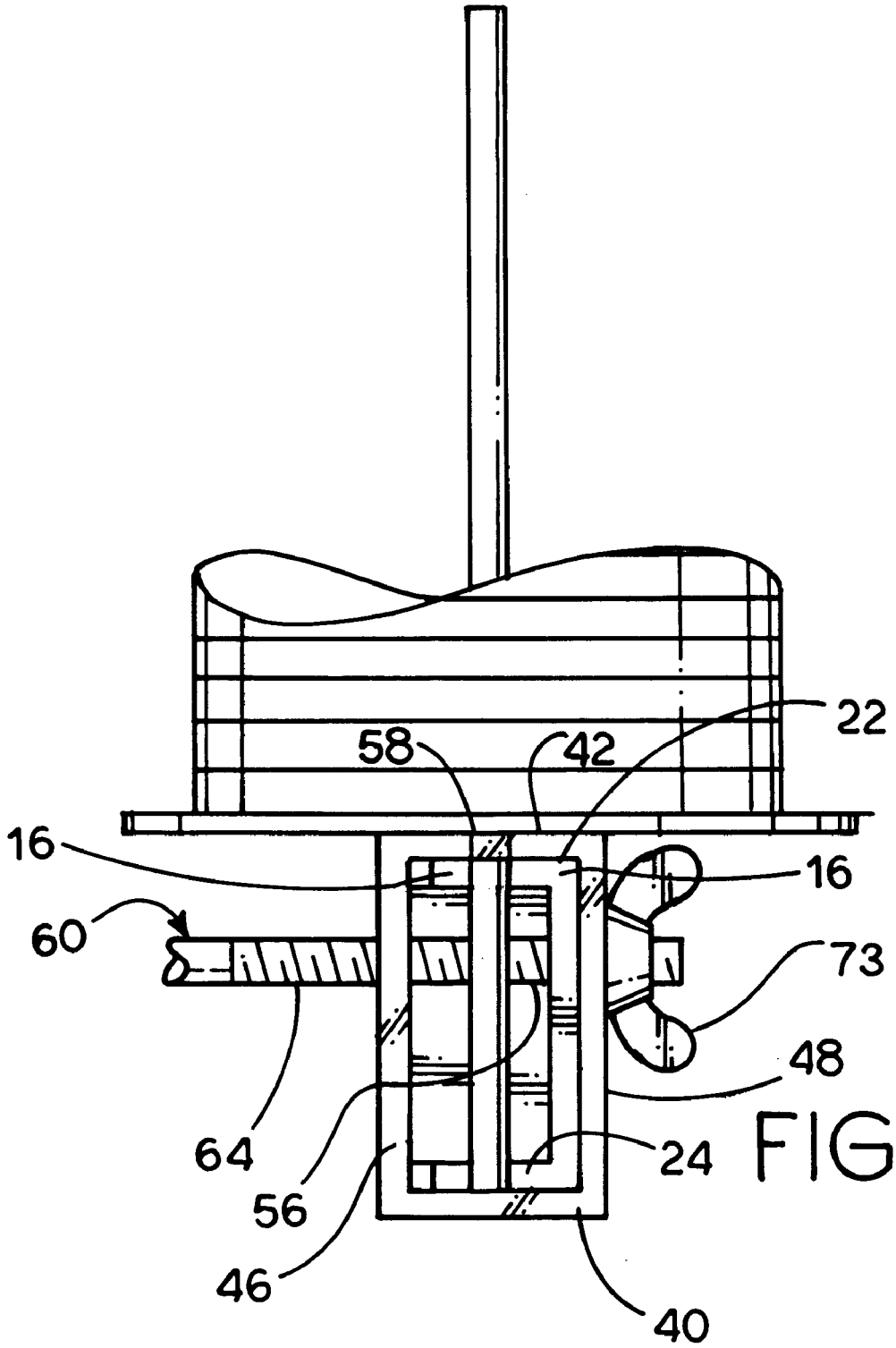
FIG. 5 is an elevational view of the end of the unit opposite to the end shown in FIG. 4.
Figure 6:
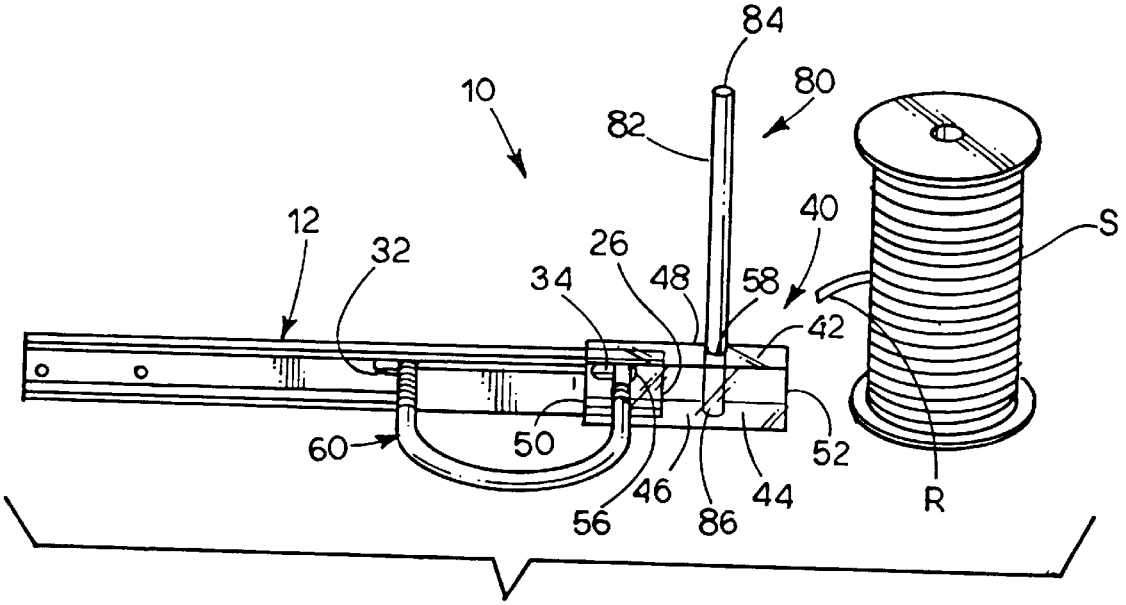
FIG. 6 is a view of the kit in which the unit of the present invention can be packaged with a spool of ribbon.
Figure 7:
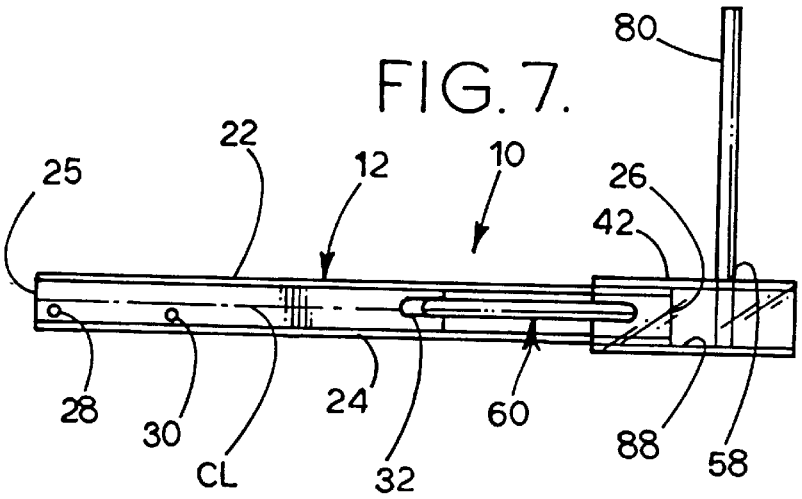
FIG. 7 is an elevational view of the unit of the present invention before a spool of ribbon is placed on the unit.

As best shown in FIG. 7, two first holes 28 and 30 are defined through central section 16 from inside surface 18 to outside surface 20 and are located near distal end 25. Holes 28 and 30 are spaced apart from each other along longitudinal dimension CL and serve a purpose that will be understood from the following discussion. As best seen in FIG. 6, two second holes 32 and 34 are defined through central section 16 from inside surface 18 to outside surface 20 and are located near proximal end 26 of section 12. Holes 32 and 34 are spaced apart from each other along longitudinal dimension CL and serve a purpose that will be understood from the following discussion.

As is best shown in FIG. 6, unit 10 further includes a one-piece support section 40 releasably mounted on central section 16 adjacent to proximal end 26. Support section 40 includes a hollow body having top section 42, a bottom section 44 and two side sections 46 and 48. A front end 50 of section 40 is open and a rear end 52 can be either open or closed as desired. Support section 40 slidably accommodates proximal end 26 of supporting bracket 12 and includes a through hole 56 which aligned with second hole 34 of supporting bracket 12 when support section 40 is mounted on supporting bracket 12. A top hole 58 is defined through top section 42 at a location spaced from through hole 56. As shown, support section 40 can be transparent, but it is not required that section 40 be transparent. Preferably, section 40 is made of plastic but other materials can be used without departing from the scope of this disclosure.

Figure 8:
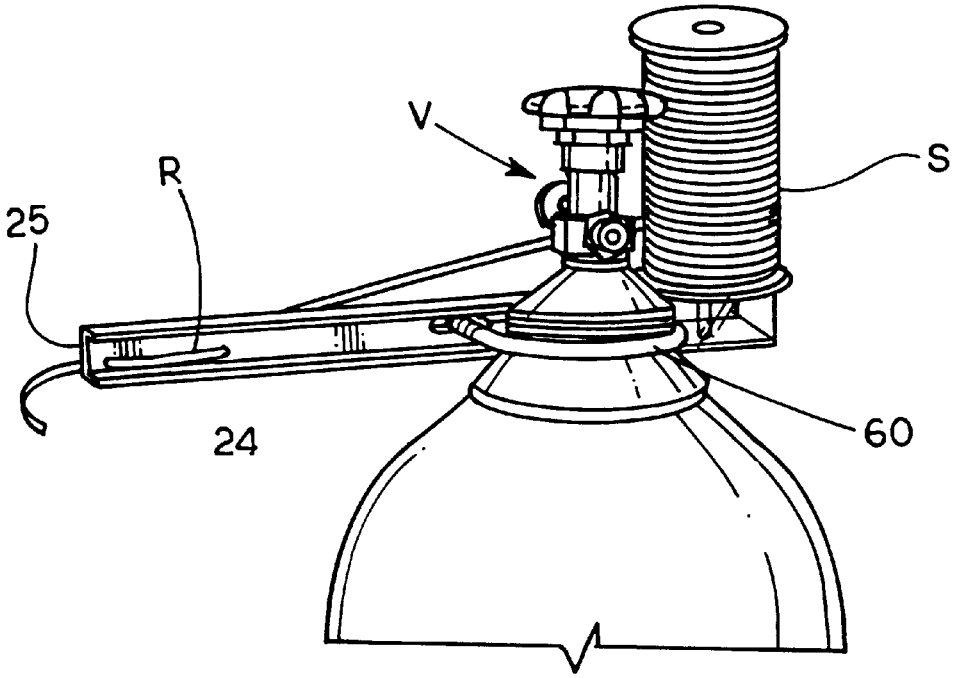
FIG. 8 is a view showing the unit in place on a tank of pressurized gas used to inflate balloons.
Figure 9:
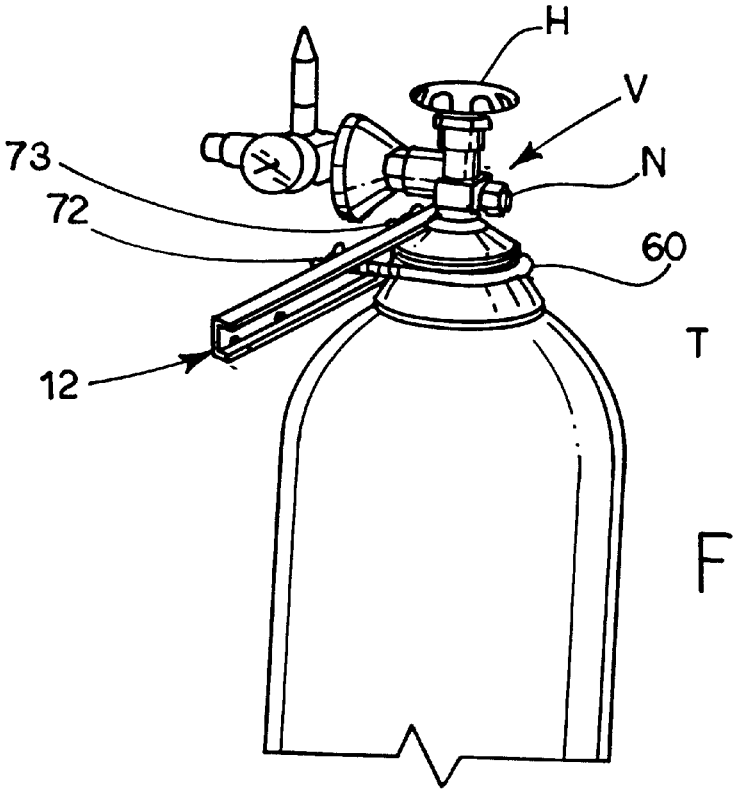
FIG. 9 is another view of the unit in place on a tank.

Unit 10 further includes a mounting element 60 for releasably mounting unit 10 on a tank T of pressurized gas used to inflate balloon B adjacent to an exhaust valve unit V of the tank. Valve unit V includes an exhaust nozzle N and an operating handle H. As is known to those skilled in the art, operation of handle H opens or closes nozzle N as desired. As will be understood from the teaching of this disclosure, a neck of a balloon is placed on nozzle N and handle H operated to inflate the balloon. Tank T is shown in FIGS. 8–10 as being cylindrical, but could be many other shapes and sizes as well. Accordingly, unit 10 is adaptable to use with a wide variety of tanks. Mounting element 60 can be used with a wide variety of tanks to provide this adaptability.

The preferred form of mounting element 60 includes a U-shaped body 62 with two legs 64 and 66 which are spaced apart a distance that corresponds to the spacing between second holes 32 and 34 whereby legs 64 and 66 can extend through holes 32 and 34 respectively for attaching unit 10 to tank T adjacent to valve unit V as shown in FIGS. 8–10. Each leg 64 and 66 includes an external thread section, such as section 70 on leg 66 near a distal end thereof and a nut, such as nuts 72 and 73 are threadably attached to the leg to draw the leg through central body 16 for drawing the unit to the tank. As can be understood from FIG. 2, leg 64 of mounting element 60 extends through through hole 56 of support section 40. Therefore, by tightening a nut onto leg 64, not only is central body 16 attached to tank T, support section 40 is attached to supporting bracket 12 and to tank T when unit 10 is being mounted on tank T.

As is best shown in FIG. 6, a ribbon supporting unit 80 includes a support rod 82 such as a dowel rod or the like, having a distal end 84 and a proximal end 86. In the assembled configuration, rod 82 is received through top hole 58 and proximal end 86 rests on inside surface 88 of support section 40 to be supported thereby. Distal end 84 is spaced above top section 42 of support section 40 as is indicated in FIGS. 6 and 7 when ribbon supporting unit 80 is in an assembled configuration as shown in FIGS. 6 and 7.

It is noted that the overall unit can be molded as one piece and can be formed of plastic or the like. The final plastic attachment or spool arm will, in the preferred form, be made of plastic with the support rod 82 molded to the rest of the body. The final unit will be all one-piece.

A spool S of ribbon has a central tube with a hollow interior. Spool S is rotatably mounted on unit 10 by having rod 80 extend through the hollow interior of the central tube as shown in FIGS. 1, 2, 11A and 11B. Ribbon R is withdrawn from the spool as shown in these figures.

An alternative form of the supporting bracket is shown in FIG. 11A as bracket 12' and includes side portions such as side portion 22' that are tapered along a longitudinal direction of bracket 12' adjacent to distal end 25' to define notches such as 90 shown in side portion 22'. The notches in the side portions are identical and are coextensive with each other and thus cannot be seen in the top plan view shown in FIG. 11A. The notches make it easier to slide a balloon neck onto and off of the distal end of the supporting bracket 12'.

Yet another form of the unit includes a supporting section 40' shown in FIG. 11B that has a plurality of top holes 58' defined through top section 46'. Holes 58' are spaced apart from each other along the longitudinal dimension of section 42' and are adapted to accommodate a plurality of support rods similar to rod 80 whereby a plurality of ribbon spools can be simultaneously supported on a unit including supporting section 40'. Also, a single ribbon spool can be moved to various locations as desired using the plurality of holes 58'. The primed notation in FIG. 11B indicates elements which correspond to like numbered elements in FIGS. 5 and 6.

Yet another form of the unit includes a spacer 100 to prevent the supporting bracket from damaging the tank when the bracket is drawn against the tank when the mounting element mounts the supporting bracket on the tank. The spacer can be formed of plastics type materials such as Nylon or the like.

Figure 16:
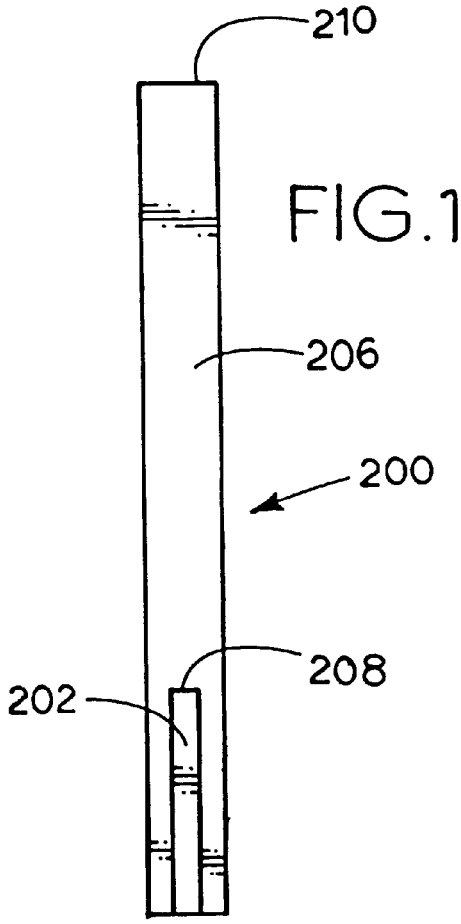
FIGS. 16 and 17 show an alternative form of a ribbon supporting element.
Figure 17:
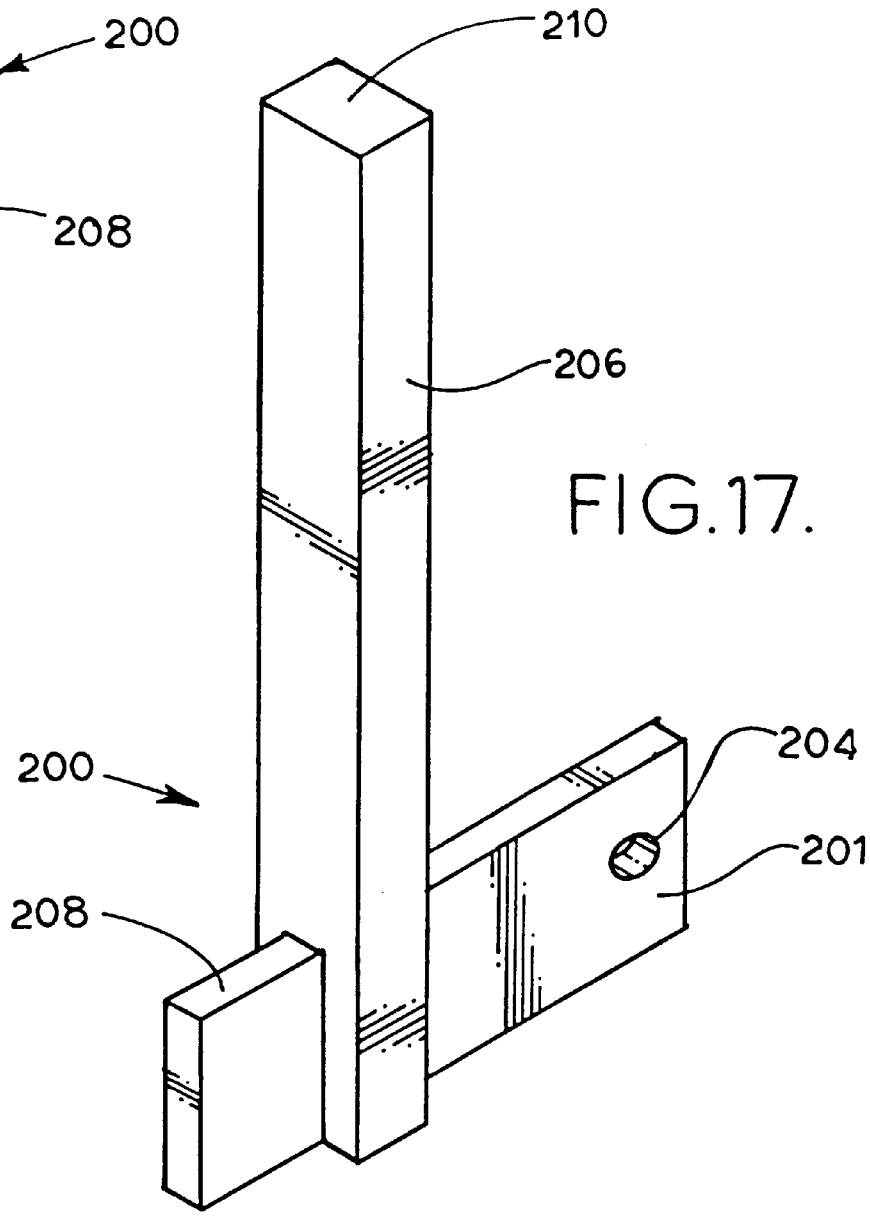

Another form of the unit includes a one-piece arm as described above along with a ribbon spool supporting element mounted on the one-piece arm. The ribbon spool supporting element of this form is indicated in FIGS. 16 and 17 as supporting element 200. Element 200 is one piece plastic and is molded as one piece. Element 200 includes a base plate 202 having a through hole 204 defined therethrough and which is located to be aligned with hole 34 to attach element 200 to the arm. A spool supporting rod 206 extends away from side edge 208 of base plate 202 a distance far enough so a spool of ribbon can be supported on rod 206 between edge 208 and distal end 210 of the rod. If desired and suitable, the spool supporting element 200 can be molded as one piece with the arm.

Having described the unit, a method of using that unit will now be described with reference to FIGS. 12–15.

A spool of ribbon is rotatably mounted on the supporting bracket as indicated in FIG. 12 and ribbon taken off the spool and threaded through the first holes 28 and 30 as is shown in FIG. 1 to extend from outside surface 20 through hole 30, along inside surface 18 and then out through hole 28 toward outside surface 20 to the position shown in FIGS. 1 and 2. This positions the ribbon on the inside of supporting bracket 12 between side portions 22 and 24.

A balloon neck is first fluidically attached to the exhaust valve of the tank and the valve operated to inflate the balloon as indicated in FIG. 12. The valve is then operated to shut off gas flow to the balloon and the balloon removed from the valve. The neck BN of the balloon is stretched around the supporting bracket near the distal end of that supporting bracket as indicated in FIG. 13. The balloon neck encircles the supporting bracket around the outer periphery of that supporting bracket and around the ribbon located on the inside of that periphery as indicated in FIG. 13.

Figure 14:
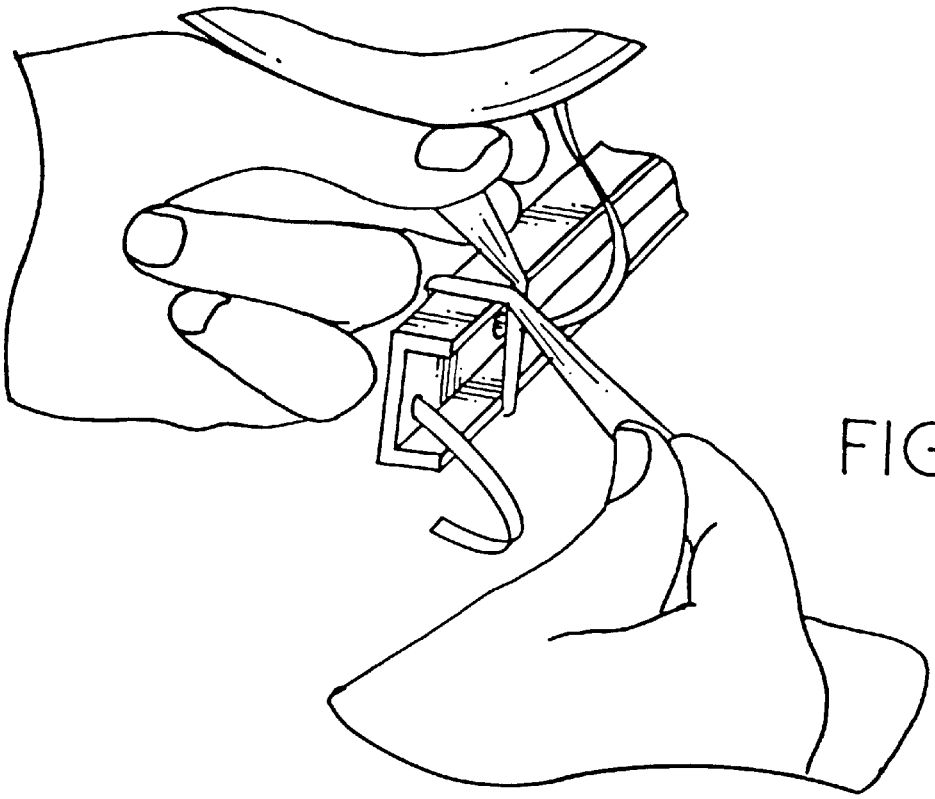

The thus looped balloon neck is then knotted by passing a portion of the balloon neck back through the loop as indicated in FIG. 14 to form a knot. By forming a loop around the outer periphery of the supporting bracket, the ribbon extending between holes 28 and 30 is captured inside the loop. The looped and knotted balloon neck is then slid off the distal end of the supporting bracket as indicated in FIG. 15. This draws ribbon in the knot as well. An appropriate length of ribbon can then be cut from the spool fed ribbon. It is preferred that the cutting be carried out downstream (with respect to the movement direction of ribbon from the spool) of the distal end of the supporting bracket so ribbon threaded through holes 28 and 30 remains after the section of ribbon is cut.

The outer dimension of the balloon arm can be varied to accommodate different size balloons. For example, the balloon arm can accommodate a seven inch balloon or a nine inch balloon, each of which will have different neck lengths. The sizing of the arm will permit the balloon to be knotted without placing undue stress on the balloon. Furthermore, the balloon arm is manufactured so that there are no sharp edges that might damage a balloon during the knotting and ribbon-applying steps.

It is understood that while certain forms of the present invention have been illustrated and described herein, it is not to be limited to the specific forms or arrangements of parts described and shown.

What is claimed is:

1. A unit used to tie a ribbon to a balloon comprising:

A) a supporting bracket which is mounted on a tank containing balloon-inflating gas near an exhaust valve of the tank and including
  (1) a one-piece section having
    (a) a central section with an inside surface and an outside surface,
    (b) two side portions on said central section, said central section and said two side portions forming a U shape,
    (c) a proximal end and a distal end,
    (d) a longitudinal dimension extending from said proximal end to said distal end and a width dimension extending between said two side portions,
    (e) two first holes defined through said central section from said inside surface to said outside surface, said first holes being located near said distal end and being spaced apart from each other along said longitudinal dimension, and
    (f) two second holes defined through said central section from said inside surface to said outside surface, said second holes being located near said proximal end and being spaced apart from each other along said longitudinal dimension, and
  (2) a one-piece support section having
    (a) a top section, a bottom section and two side sections,
    (b) a top hole through the top section of said support section,
    (c) a through hole defined through each of the two side sections of said support section, and
    (d) a support end portion which slidably accommodates the proximal end of said one-piece section with one of the second holes of said one-piece section aligned with the through holes of said support section;

B) a mounting element having
  (1) a U-shaped body with two legs,
  (2) the legs of said mounting element being spaced apart a distance equal to the space between the two second holes of said one-piece section whereby said legs extend through said two second holes and through the through holes of said support section when said mounting element mounts said supporting bracket on the tank, and
  (3) fasteners attaching said mounting element to the tank and to said one-piece section and to said support section when said mounting element mounts said supporting bracket on the tank; and C) a ribbon supporting unit having
  (1) a support rod extending through the top hole of said support section and abutting an inside surface of the bottom section of said support section and having a distal end located outside said support section and spaced from the top section of said support section, and (2) a spool of ribbon rotatably supported on said support rod and resting on an outside surface of the top section of said support section.

2. The unit defined in claim 1 further including ribbon on said spool, said ribbon extending through the first holes of said one-piece section.

3. The unit defined in claim 2 further including screw threads on the legs of the U-shaped body of said mounting element and bolts threadably received on said screw threads when said mounting element mounts said supporting bracket on the tank.

4. The unit defined in claim 1 further including a notch defined in each of the side portions of said one-piece section, each notch being positioned adjacent to the distal end of said one-piece section and being co-extensive with the other notch.

5. The unit defined in claim 1 further including a plurality of top holes defined in the top section of said support section.

6. The unit defined in claim 1 wherein the U-shaped body of said mounting elements encircles the tank near an exhaust valve of the tank when said mounting element mounts said supporting bracket on the tank.

7. The unit defined in claim 1 further including a spacer on said supporting bracket in position to abut the tank when said mounting element mounts said supporting bracket on the tank.

8. A unit used to seal a balloon and tie a ribbon thereto comprising:

A) a U-shaped supporting bracket having a distal end and a proximal end and a length dimension extending from said distal end to said proximal end, a central body and two side portions extending from said central body, an inside surface and an outside surface on said central body, two ribbon-receiving holes defined through said central body from said inside surface to said outside surface, two mounting element-receiving holes defined through said central body from said inside surface to said outside surface, said ribbon-receiving holes being located near said proximal end and said mounting element-receiving holes being located near said proximal end, said holes all being spaced apart from adjacent holes along said length dimension;

B) a hollow section having a front side, a rear side, a top side, a bottom side, a front end and a rear end, said support section being sized to telescopingly receive therein the proximal end of said supporting bracket when said support section is mounted on said supporting bracket, mounting element-receiving holes defined through the front side and through the rear side of said support section to be aligned with each other and with one of the mounting element-receiving holes on said supporting bracket when the proximal end of said supporting bracket is telescopingly received in said hollow support section, and a spool supporting rod-receiving hole defined through the top side of said support section;

C) a spool supporting rod which is sized to slidably extend through the supporting rod-receiving hole in the top side of said support section and to have one end thereof abut the bottom side of said support section and another end thereof located spaced from the top side of said support section when said spool supporting rod is positioned on said supporting section; and D) a mounting element having two legs and a body, said legs being spaced apart from each other a distance corresponding to the space between the two mounting element-receiving holes on said supporting bracket whereby one leg will extend through one of the two mounting element-receiving holes on said supporting bracket and the other leg of said two legs will extend through the mounting element-receiving holes on both said support section and said supporting bracket when said support section and said mounting element are mounted on said supporting bracket.

9. The unit defined in claim 8 further including a spacer on said supporting bracket between said two mounting element-receiving holes on said supporting bracket.

10. The unit defined in claim 8 further including a ribbon-supporting spool having a central bore for rotatably receiving said spool supporting rod when said ribbon-supporting spool is mounted on said spool supporting rod.

11. The unit defined in claim 10 wherein said ribbon-supporting spool includes a flange that is positioned to engage the top side of said hollow section when said ribbon-supporting spool is supported on said hollow section by said spool supporting rod whereby said ribbon-supporting spool is supported on said hollow section when said ribbon-supporting spool is supported on said hollow section by said spool supporting rod.

12. The unit defined in claim 8 further including fasteners which are attached to said mounting element to mount said mounting element on a tank of pressurized gas.

13. A unit used to tie a ribbon to a balloon comprising:

A) a supporting bracket which is mounted on a tank containing balloon-inflating gas near an exhaust valve of the tank and including (1) a one-piece section having (a) a central section with an inside surface and an outside surface, (b) two side portions on said central section, said central section and said two side portions forming a U shape, (c) a proximal end and a distal end, (d) a longitudinal dimension extending from said proximal end to said distal end and a width dimension extending between said two side portions, (e) two first holes defined through said central section from said inside surface to said outside surface, said first holes being located near said distal end and being spaced apart from each other along said longitudinal dimension, and (f) two second holes defined through said central section from said inside surface to said outside surface, said second holes being located near said proximal end and being spaced apart from each other along said longitudinal dimension, and (2) a one-piece supporting element having (a) a base plate with an edge, (b) a through hole defined through the base plate of said supporting element, and (c) a ribbon supporting rod extending from the base plate of said supporting element from the edge of the base plate of said supporting element;

B) a mounting element having (1) a U-shaped body with two legs, (2) the legs of said mounting element being spaced apart a distance equal to the space between the two second holes of said one-piece section whereby said legs extend through said two second holes and through the through holes of said one piece supporting element when said mounting element mounts said supporting bracket on the tank, and (3) fasteners attaching said mounting element to the tank and to said one-piece section and to said one piece supporting element section when said mounting element mounts said supporting bracket on the tank; and C) a spool of ribbon rotatably supported on the ribbon supporting rod of said supporting element.

14. The unit defined in claim 13 wherein said ribbon supporting section is one-piece with the one-piece section of said supporting bracket.

* * * * *